US005557903A

United States Patent [19]

Haddock

[11] Patent Number: 5,557,903

[45] Date of Patent: Sep. 24, 1996

[54] MOUNTING CLIP FOR PANELED ROOF

[76] Inventor: Robert M. M. Haddock, 8655 Table Butte Rd., Colorado Springs, Colo. 80908

[21] Appl. No.: 285,280

[22] Filed: Aug. 1, 1994

[51] Int. Cl.[6] ..... E04B 1/36

[52] U.S. Cl. ..... 52/508; 52/512; 52/537; 52/408

[58] Field of Search ..... 52/508, 512, 537, 52/550, 551, 408, 409, 410, 235, 573.1; 248/298.1, 419, 429, 430

[56] References Cited

U.S. PATENT DOCUMENTS

| | | | |
|---|---|---|---|
| 3,064,772 | 11/1962 | Clay | 52/508 |
| 3,335,995 | 8/1967 | Pickles | 248/419 X |
| 3,667,182 | 6/1972 | Stemler | 52/573.1 X |
| 4,848,858 | 7/1989 | Suzuki | 248/298.1 X |
| 5,187,911 | 2/1993 | Cotter | 52/537 X |
| 5,213,300 | 5/1993 | Rees | 248/429 |
| 5,408,797 | 4/1995 | Bellem | 52/573.1 X |

FOREIGN PATENT DOCUMENTS

| | | | |
|---|---|---|---|
| 3166452 | 7/1991 | Japan | 52/573.1 |

*Primary Examiner*—Carl D. Friedman
*Assistant Examiner*—W. Glenn Edwards
*Attorney, Agent, or Firm*—Sheridan Ross & McIntosh

[57] ABSTRACT

A mounting clip for installing a roofing panel onto an underlying support structure in sliding relation therewith. In one embodiment, the mounting clip generally includes a first member, having a base and first and second laterally disposed channel members, and a second member, having a platform and first and second laterally disposed leg members slidably engagable with said first and second channel members, respectively. Preferably, the clip assembly is substantially symmetrical to provide for a desired force distribution and to impart a desired degree of strength.

45 Claims, 8 Drawing Sheets

MOUNTING CLIP FOR PANELED ROOF

FIELD OF THE INVENTION

The present invention relates generally to roofs formed from panels and, more particularly, to a clip for slidably interconnecting a roofing panel with an underlying support structure.

BACKGROUND OF THE INVENTION

One popular type of metal roof is generally referred to in the industry as a standing seam metal roof. In a standing seam metal roof, the longitudinal edges of the individual metal panels have relatively complex configurations which allow for an interlocking relationship with an adjacent and similarly formed panel. The region of the interlock extends upwardly from the roof to define a "standing seam" which runs parallel with the pitch of the roof. A plurality of clips are secured to each of the standing seams at spaced locations and are interconnected with the underlying support structure. Based upon the type of interlocking relationship between adjacent panels used in standing seam roofs, the panels are able to slide relative to each other to a degree and the substructure along the seam to accommodate, for instance, for thermal expansion and contraction. Notwithstanding the performance benefits of standing seam roofs, the panels themselves are relatively expensive and the labor costs for installing these types of roofs is relatively high since specially trained installers are normally utilized.

Another type of metal roof is commonly referred to in the industry as a nestable/trapezoidal/through-fastened/face-fastened roof (hereinafter "nestable roofs"). Panels for forming nestable roofs generally have ribs or crowns of varying configurations which run parallel with the pitch of the roof with a lower base or pan portion therebetween. These types of metal panels are typically manufactured from relatively thin gauge metal in a variety of widths and lengths and are significantly less expensive than standing seam roof panels since there are no complex configurations on the longitudinal edges of the panels. That is, adjacent panels are merely placed in an overlapping relation and secured to the substructure. In this regard, these types of metal panels have traditionally been installed by fastening the panels directly to the substructure by driving screws or the like directly through one or more of the base or pan portions of each panel. Consequently, installation costs are significantly lower than those associated with standing seam roofs since specially trained installers are not required.

Although economic considerations favor nestable roofs over standing seam roofs, performance considerations still favor standing seam roofs. That is, due to the manner in which the nestable roofs are installed, the nestable roof does not adequately account for thermal expansion and contraction. That is, there is resistance to movement of the individual panels in a nestable roof in a direction parallel with the pitch of the roof, primarily where the individual panels are pinned to the substructure in the above-noted manner. Consequently, these types of movements have a tendency to produce cracks or tears in the panels where pinned to the substructure and may also damage the substructure itself. Therefore, the potential for developing undesirable leaks is relatively significant in nestable roofs. This is compounded by the fact that the locations of attachment (i.e., the base or pan portion of the panel which is the lowest part of the panel) is in the drainage plane of the roof.

Based upon the foregoing, there is a need for an intermediately priced metal panel roof system, primarily one which has some of the performance attributes of a standing seam roof with regard to expansion/contraction capabilities, as well as some of the economic attributes of a nestable roof.

SUMMARY OF THE INVENTION

Accordingly, an object of the present invention is to provide a clip for securing a roofing panel to an underlying support structure which allows the roofing panel to move longitudinally relative to the support structure (i.e., parallel to the pitch of the roof) to compensate, for instance, for the thermal expansion and contraction of the roofing panel.

Another object of the present invention is to provide a clip for securing a roofing panel to an underlying support structure in which the vertical extent thereof is adjustable/variable to a degree.

Another object of the present invention is to provide a clip for securing a roofing panel to an underlying support structure which accommodates a wide variety of roofing panels and support structures.

Another object of the present invention is to provide a clip for securing a roofing panel to an underlying support structure which is economical to manufacture and install.

The clip assembly of the present invention generally includes first and second members which are slidably interconnected with the first member being connectable to the roof's sub/support structure and the second member being connectable with the panel. The portions of the first and second members which engage the underlying support structure and panel, respectively, are vertically displayed and are preferably symmetrically positioned about a central longitudinal axis to enhance the strength characteristics of the clip assembly.

In one embodiment, the above-noted first member includes a base having first and second laterally displaced channel members interconnected therewith, and the second member includes a platform having first and second laterally displaced leg members interconnected with and extending away from the platform to provide for the noted vertical displacement between the first and second members. At least a portion of the first and second leg members are slidably interconnected with the first and second channel members, respectively, to form a clip assembly for securing portions of a panel in sliding relation with an underlying support structure. The base may include one or more holes to facilitate attachment to the underlying support structure with suitable fasteners, such as screws.

The first and second channel members of the above-noted first member each preferably include a first portion interconnected with the base along substantially the entire length of the base and such first portions extend away from the base at an angle. Further, the first and second channel members each preferably include a second portion interconnected with the corresponding first portion by a generally U-shaped end and such second portions extend from the generally U-shaped end back toward the base. Consequently, each corresponding first and second portion and intermediate U-shaped end collectively define a channel to provide for an interlocking relationship with the second member. Preferably, the angle between each of the first and second channel members and the base is an acute angle.

In order to facilitate the above-noted interlock between the first and second members, the first and second leg members of the second member each preferably include a first portion interconnected with the platform along substantially the entire length of the platform and such first portions extend away from the platform and toward the base at an angle. The first and second leg members each further preferably include a second portion interconnected with the corresponding first portion by a generally U-shaped end and such second portions extend away from the base and back toward the platform. Consequently, each corresponding first and second portion and intermediate U-shaped end collectively define a channel to provide for an interlocking relation with the first member. That is, each second portion of the first and second leg members of the second member is positioned within one of the channels defined by the first and second portions of the first and second channel members of the first member. Since the uppermost end of the channels of the first member is closed by the noted generally U-shaped end, the first and second members cannot be pulled apart (vertically) absent excessive force.

The clip assembly of the present invention may include one or more features for facilitating installation of the metal roof. For instance, one or more notches or the like may be formed on the above-noted base of the first member which is again directly attached to the substructure. These notches may be used to align the base and thus the clip assembly on the roof by positioning the notches on a chalk line previously snapped onto the roof. Moreover, one or more projections may be formed on the lower surface of the base of the first member. These projections may be used to "tack" the base onto the underlying support structure until more permanently attached with the noted fasteners, or may be used to center the base and thus the clip assembly on an installment strip positioned between the clip assembly and the main support structure (e.g., a plywood deck).

The clip assembly may include a guide for longitudinally centering the second member on the first member. The clip assembly of the present invention may further provide for a limitation on the range of relative sliding motion between the first and second members. For instance, a slot or channel may be formed in one of the first and second members, and a projection may be formed in the other of the first and second members and positioned within the slot or channel. However, preferably there is no such limitation on the amount of relative movement between the first and second members. In this case, it may be desirable to otherwise limit the amount of movement of certain panels which is parallel to the pitch of the roof.

Based upon the foregoing, it will be appreciated that the clip assembly of the present invention is particularly suited for installing a nestable roof and improving upon the performance thereof. That is, due to the slidable interconnection provided by the clip assembly of the present invention, the performance of the nestable roof is improved over the same roof installed by conventional techniques.

DETAILED DESCRIPTION

Figure 1:
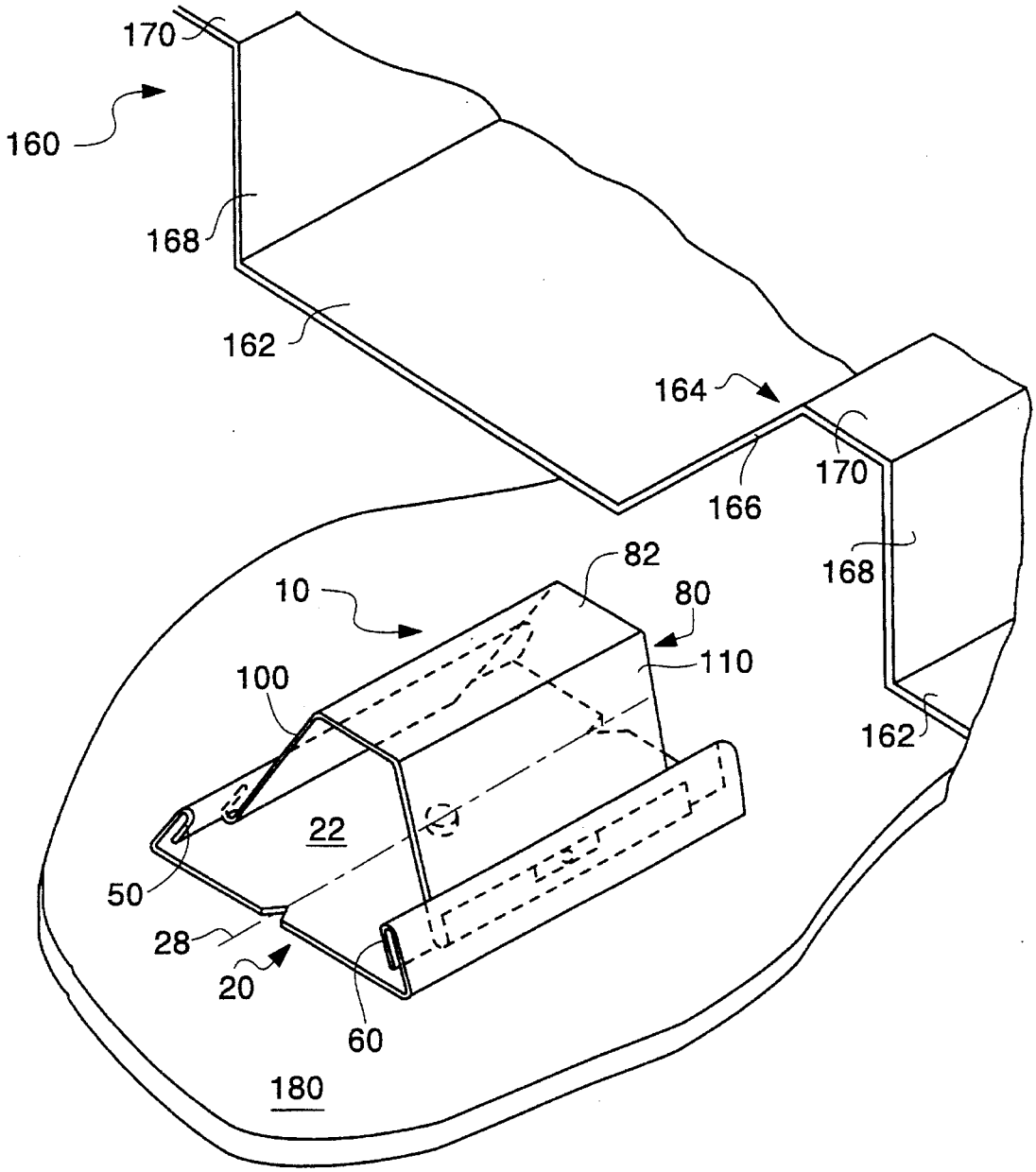
FIG. 1 is a perspective view of one embodiment of a clip assembly in accordance with the present invention and one type of roofing panel which may be installed therewith.
Figure 1A:
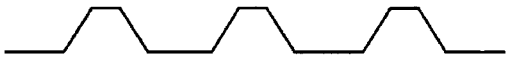
FIG. 1A is an end view of the roofing panel of FIG. 1.

The present invention will be described with reference to the accompanying drawings which assist in illustrating its various features. Generally, the present invention is a mounting clip for installing a roof from suitable panels over an appropriate substructure, such as an existing metal roof, a substantially flat deck (e.g., wood, metal), open structures, or a deck having laterally extending strips installed thereon. Although the mounting clips of the present invention may be used in the installation of a variety of configurations of panels, one type of panel which may particularly realize the benefits offered by the present invention is illustrated in FIGS. 1 and 1A and generally is used to form one type of the above-identified nestable roof. The panel 160 is metal and has alternating longitudinally extending troughs 162 and ribs 164. The ribs 164 are generally trapezoidal in shape, having first and second oppositely sloped sidewalls 166, 168 and a substantially flat peak 170. Typically, the panels 160 are installed on the roof such that the troughs 162 and ribs 164 run parallel with the pitch of the roof (i.e., from the peak of the roof to the eaves). Moreover, when installed with the mounting clips of the present invention, the panels 160 are able to move in this same direction due, for instance, to thermal expansion/ contraction such that the roof formed from panels 160 actually performs to a degree like a standing seam roof.

A clip assembly 10 in accordance with principles of the present invention is illustrated in FIGS. 1–4 and as noted is for attaching roofing panels to an appropriate substructure 180 (FIG. 1). Initially, it can be seen that the clip assembly 10 is designed to desirably interface with the panel 160 and to allow the panel 160 to move longitudinally or axially at least to a degree. In this regard, the clip assembly 10 generally includes a first member 20 and a second member 80 which are slidably interconnected, the first member 20 being secured to the substructure 180 and the second member 80 being secured to the panel 160.

Figure 2:
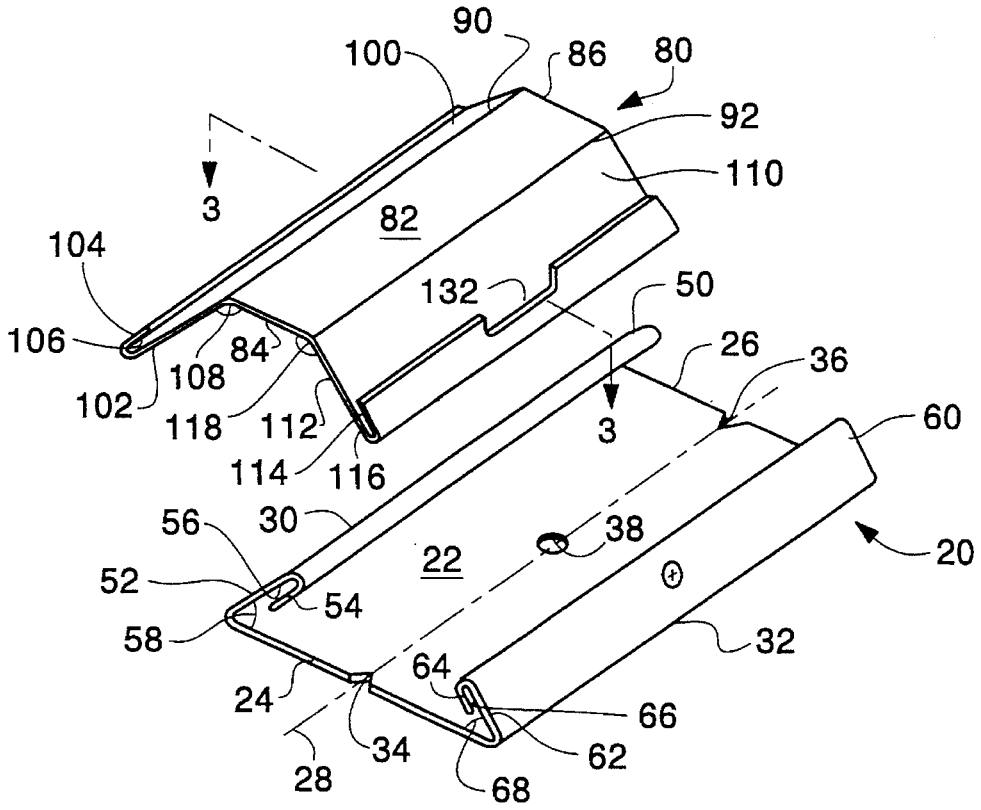
FIG. 2 is an exploded, perspective view of the clip assembly of FIG. 1.

As noted and referring to FIG. 2, the first member 20 is secured to the underlying support structure. In this regard, the base 22 includes a hole 38 disposed substantially in the center of the base 22 for receiving a fastener, such as a screw or the like, although it will be appreciated that more fasteners could of course be utilized and that pre-drilled holes 38 are not necessarily required. Moreover, the first member 20 and the second member 80 are slidably interconnected to allow for relative longitudinal/axial movement therebetween. This slidable interconnection is facilitated in part by the first and second channel members 50, 60, respectively, of the first member 20. The first channel member 50 extends from the first side 30 of base 22 along substantially the entire length of first member 20. Similarly, the second channel member 60 extends from the second side 32 of base 22 along substantially the entire length of first member 20.

The first and second channel members 50, 60 are structured to provide for a vertically interlocking, yet longitudinally slidable engagement with the second member 80. In this regard, the first and second channel members 50, 60 include first portions 52, 62, respectively, which extend upwardly from the base 22 generally toward the central axis 28 at an angle 58, 68, respectively, and which have substantially U-shaped ends. The first and second channel members 50, 60 further include second portions 54, 64, respectively, which extend back downwardly toward the base 22 away from the central axis 28 such that inverted (i.e., downwardly projecting), substantially U-shaped channels 56, 66 are formed by the first portions 52, 62 and the second portions 54, 64.

The base 22 of the first member 20 is substantially rectangular, having a length defined by the distance between a first edge 24 and a second edge 26 along the longitudinal axis 28, and a width defined by the distance between a first side 30 and a second side 32 of base 22 along an axis perpendicular to longitudinal axis 28. In the disclosed embodiment, the base 22 measures approximately three and one half inches in length (e.g., 3.5") and one and one half inches in width (e.g., 1.5"). Moreover, the first portions 52, 62 of the first and second channel members 50, 60, respectively, extend upwardly from base 22 approximately one half inch (e.g., 0.5"), and the second portions 54, 64 of the first and second channel members 50, 60, respectively, extend downwardly approximately one quarter inch (e.g., 0.25"). Furthermore, the interior angle 58, 68 between the base 22 and the channel members 50, 60, respectively, measures approximately 60 degrees. However, the angles 58, 68 may range from about 90 degrees to about 30 degrees and still provide sufficient strength characteristics. Notwithstanding the presentation the specific dimensions and configurations for the first member 20 herein, it will be appreciated that the sizes and/or the various relative orientations may be modified in accordance with the requirements of a particular roofing design. Nonetheless, preferably the first member 20 maintains a substantially symmetrical configuration.

The first member 20 and the second member 80 are slidably interconnected, with the panel 160 being directed secured to the second member 80, more particularly its peak 170, by one or more suitable fasteners (FIGS. 8, 9, and 10). In this regard, the first leg member 100 of the second member 80 extends from the first side 90 of the platform 82 along substantially the entire length of platform 82, and the second leg member 110 extends from the second side 92 of the platform 82 along substantially the entire length of platform 82. The first and second leg members 100, 110 each have a first portion 102,112, respectively, which extends downwardly from platform 82 at an angle and has a substantially U-shaped end. Moreover, the first and second leg members 100, 100 each further include a second portion 104, 114, respectively, which extends upwardly approximately toward the platform 82. Consequently, the first portions 102, 112 and second portions 104, 114 collectively define substantially U-shaped channels 106, 116, respectively.

The platform 82 of second member 80 is substantially rectangular and thus has a length defined by the distance between a first edge 84 and a second edge 86 and a width defined by the distance between a first side 90 and a second side 92 of platform 82. In the disclosed embodiment, the platform 82 measures approximately three inches (e.g., 3.0") in length and three-fourths inch (e.g., 0.75") in width. Moreover, the first portions 102, 112 of the first and second leg members 100, 110, respectively, extend downwardly from platform 82 approximately one inch (e.g., 1.0"), the second portions 104, 114 of the first and second leg members 100, 110, respectively, extend upwardly approximately one quarter inch (e.g., 0.25") toward the platform 82, and the interior angles 108, 118 between the platform 82 and the leg members 100, 110 measures approximately 120 degrees. However, the angles 108, 118 may range from about 150 degrees to about 90 degrees, although an obtuse angle is preferred. Notwithstanding the presentation the specific dimensions and configurations for the second member 80 herein, it will be appreciated that the sizes and/or the various relative orientations may be modified in accordance with the requirements of a particular roofing design. Nonetheless, preferably the second member 80 maintains a substantially symmetrical configuration.

Figure 3:
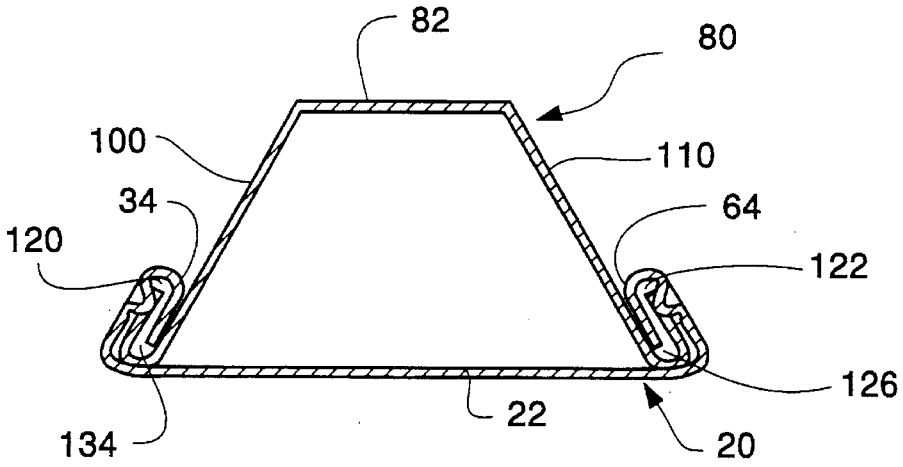
FIG. 3 is a cross-sectional view of the clip assembly of FIG. 1 taken along line 3—3.

The clip assembly 10 is assembled by slidably engaging the respective U-shaped channels of the first member 20 and second member 80. As illustrated in FIG. 3, when the first member 20 and second member 80 are slidably interconnected, the second portions 54, 64 of the first and second channel members 54, 64 are in contact with portions of leg members 100, 110 resulting in a slight frictional force (e.g., about 5 pounds) between portions of the exterior surfaces of leg members 100, 110 and the interior surfaces of channel members 50, 60. This frictional force facilitates securing the clip assembly 10 in place.

Figure 8A:
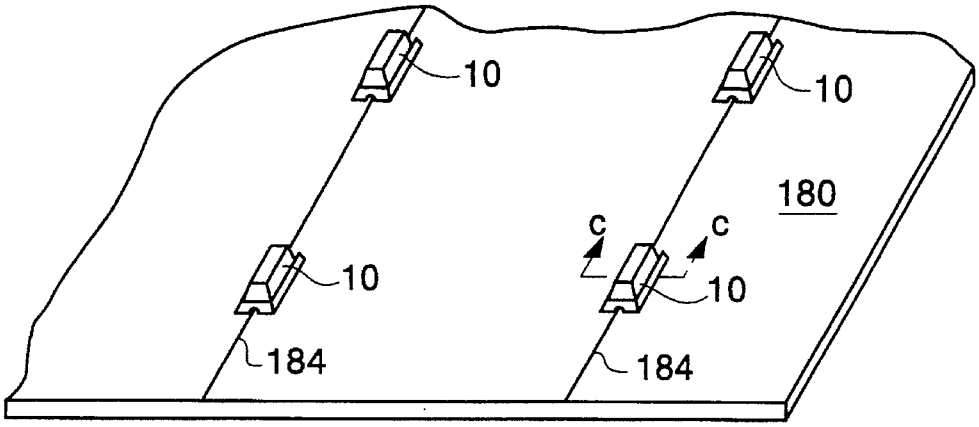
FIG. 8A is a perspective view of a portion of plurality of the clip assemblies of FIG. 1 positioned on a substantially flat underlying support structure.
Figure 8C:
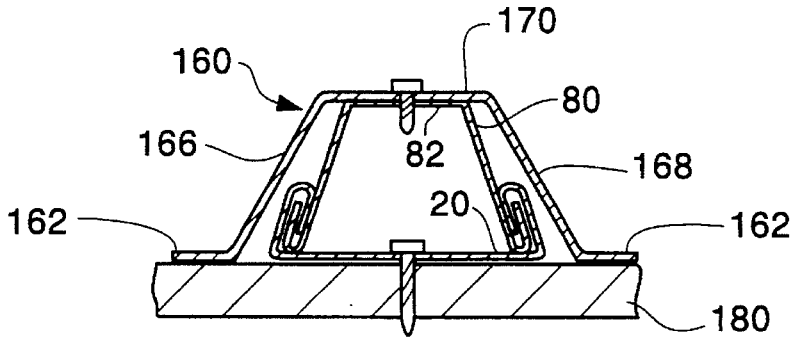
FIG. 8C is a cross-sectional view of a clip assembly of FIG. 8A, taken along line C—C, with a ribbed roof panel attached to the clip assembly.
Figure 9A:
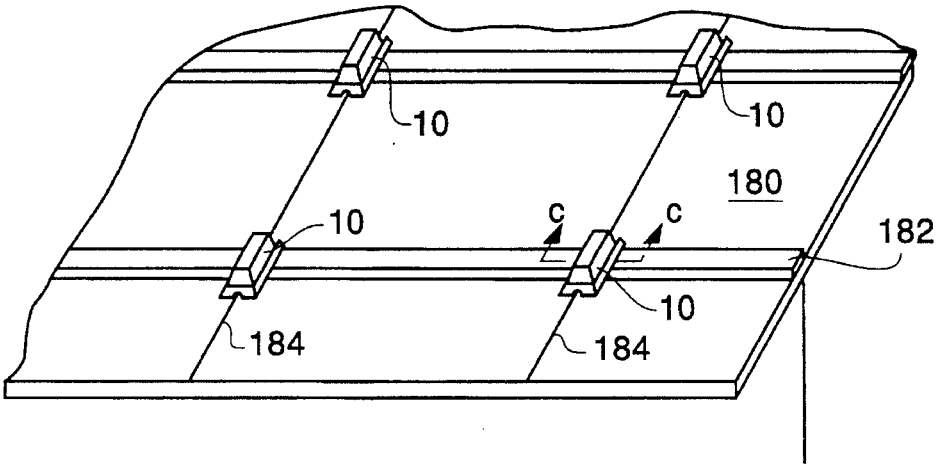
FIG. 9 a perspective view of a plurality of the clip assemblies of FIG. 1 positioned on an underlying support structure employing laterally mounted intermediate strips.
FIG. 9B is a side view of the clip assembly of FIG. 9A.
FIG. 9C is a cross-sectional view of a clip assembly of FIG. 9A, taken along line C—C, with a ribbed roof panel attached to the clip assembly.
Figure 9C:
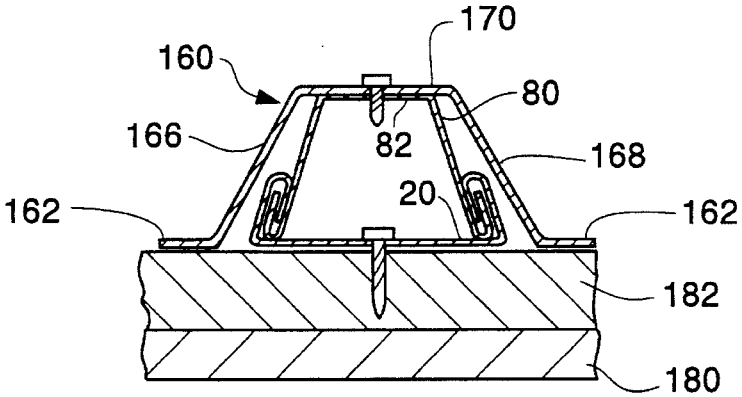
Figure 10A:
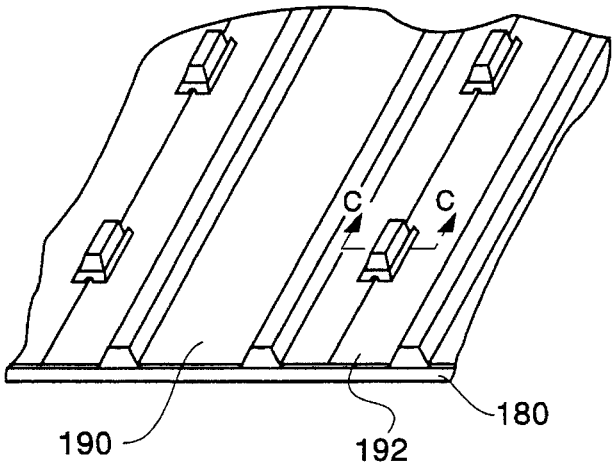
FIG. 10A is a perspective view of a portion of plurality of the clip assemblies of FIG. 1 installed on an existing ribbed metal roof structure.
Figure 10C:
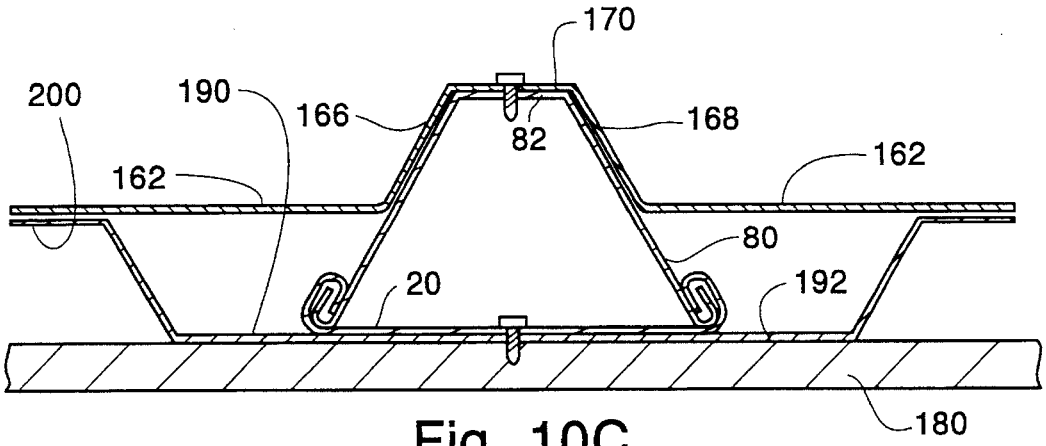
FIG. 10C a cross-sectional view of a clip assembly of FIG. 10A, taken along line C—C, with the ribbed roof panel attached to the clip assembly.

Advantageously, the bottom of leg members 100, 110 are also substantially in contact with base 22 when the clip assembly 10 is in a normal position, as illustrated in FIG. 3, or when the clip assembly 10 is under positive load, such as the weight of a roof panel, as illustrated in FIGS. 8C, 9C, or 10C. Therefore, the weight of the roof panel, as well as snow, ice or other debris on the roof panel, may be distributed substantially evenly between the first and second leg members 100, 110 to provide a strong and stable structure. That is, due to the symmetrical configuration of the clip assembly 10, the forces may be substantially evenly distributed and the clip assembly 10 also provides a desired degree of stability.

It should be noted that the interlocking channel structure of the disclosed clip assembly 10 also allows for limited relative movement in a vertical direction between the first member 20 and the second member 80. More particularly, the interlocking channel structure defines two upper gaps 120, 122 and two lower gaps 124, 126 which allow for limited relative vertical movement between the first member 20 and second member 80. This feature provides a roof panel secured with a clip assembly 10 of the present invention a limited range of vertical motion, allows the clip assembly 10 to be used with roof panels of different heights and/or compensates for certain degrees of variations during installation. In the disclosed embodiment, the noted gaps measure approximately one eighth inch (e.g., 0.125"), although it should be appreciated that the size of the gaps may vary in accordance with different design requirements.

When the clip assembly 10 is assembled, it is substantially symmetrical about its central axis 28 for securing portions of the roof panel 160 to the underlying support structure 180. Moreover, the base 22 of the first member 20 and the platform 82 of the second member 80 are displaced by a predetermined degree. In the case of the clip assembly 10, the base 22 of the first member 20 and the platform 82 of the second member 80 are each disposed substantially entirely in first and second reference planes which are offset by a predetermined amount, which is approximately the height of the rib 164 of the panel 160 (the distance from a plane containing the trough 162 and the peak 170).

The first member 20 and second member 80 are each preferably integrally formed (i.e., of unitary construction), and such are preferably formed from a relatively light (e.g., 22 to 18 gauge) coated steel using a combination of stationary and rolling presses to form bends in the steel. However, it will be appreciated that the clip assembly 10 may be formed from other materials, such as aluminum or rigid plastic, depending upon the particular requirements of the clip assembly. Further, alternate manufacturing processes consistent with other such materials, such as extrusion or molding, may be employed to form the clip assembly 10.

Figure 5:
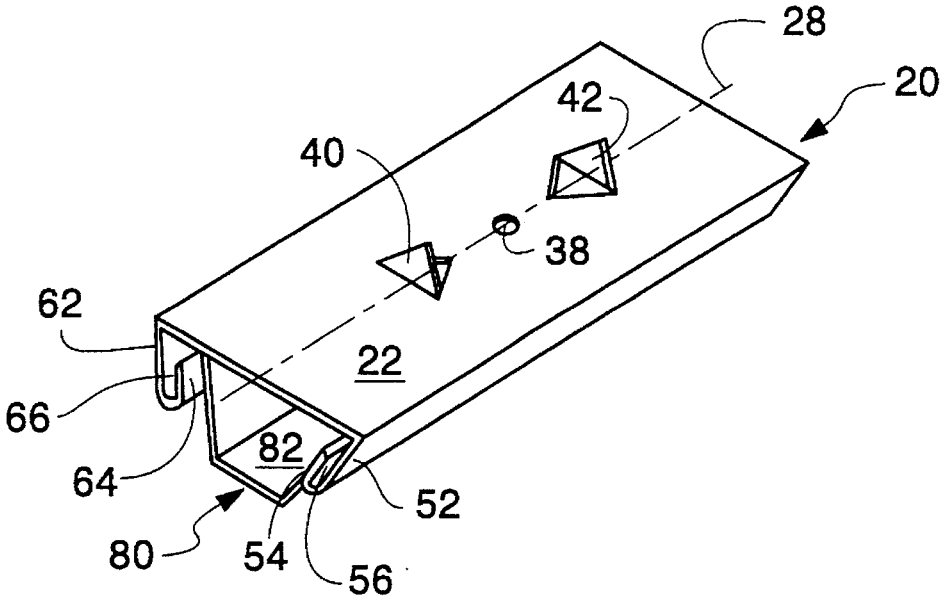
FIG. 5 is a perspective view of the bottom of the clip assembly of FIG. 1 incorporating two downwardly extending positioning protections.
Figure 4:
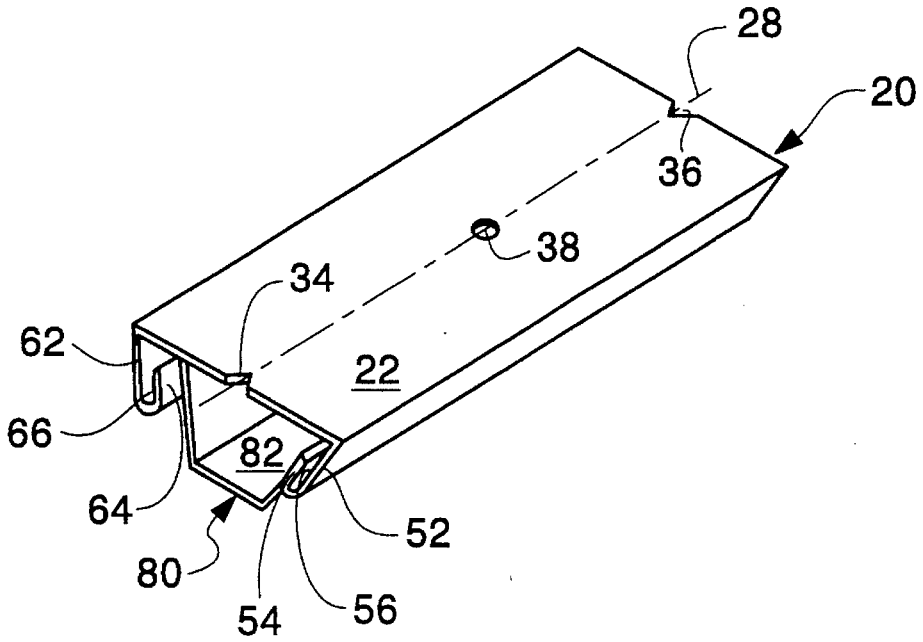
FIG. 4 is a perspective view of the bottom of the clip assembly of FIG. 1.
Figure 9B:
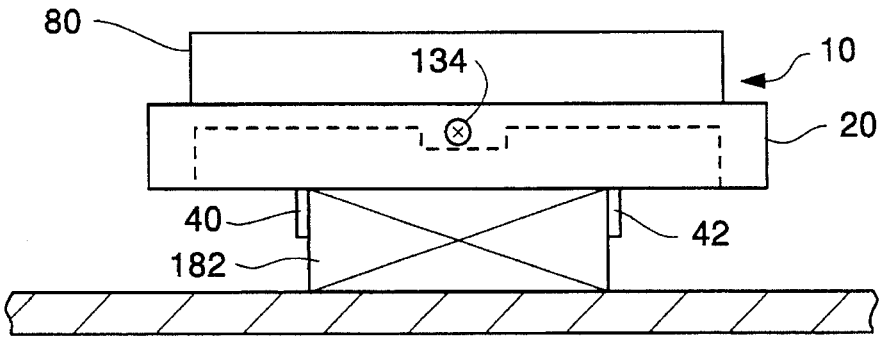

The clip assembly 10 may also include various alignment or positioning features for facilitating installation. For instance, referring to FIGS. 2 the base 22 of the first member 20 as illustrated in FIGS. 2 and 4 may include two triangular notches 34, 36, each having a point centered on the central axis 28. The notches 34, 36 allow the user to align the first member 20 along a predetermined longitudinal axis, such as a chalk line, on an underlying support structure. In FIG. 5, the clip assembly 10 includes two substantially triangularly-shaped wedges 40, 42 which are cut/punched along two sides from the base 22 and bent in a generally downward direction. One corner of each triangular hole in the base 22 is positioned on the central axis 28. These downwardly extending triangularly-shaped wedges 40, 42 may be used to "tack" the first member 20 to an underlying support structure such as a plywood sub-roof by driving or pushing the wedges 40, 42 into the plywood sub-roof or other structure. Alternatively, the downwardly extending triangular wedges 40, 42 may be used to position the first member such that the clip assembly 10 is longitudinally centered on a laterally extending roofing installation strip, as illustrated in FIGS. 9A and 9B and as will be discussed in more detail below. In this case, the installation strip would be snugly received between the two wedges 40, 42. It will be appreciated that this longitudinal centering of the clip assembly 10 on the roofing strip could be achieved with a single, properly positioned downwardly projection such as a wedge.

The clip assembly 10 of the present invention may also be configured to limit the amount of axial relative movement between the first member 20 and the second member 80, such as by including an interlocking slot and detent assembly 130. Referring to FIGS. 2 and 3 and in this regard, a longitudinally extending slot 132 is cut into the second portion 114 of the leg member 110. An outwardly projecting detent 134 may be formed on the first portion 62 of the leg member 60. This detent 134 would then be received within the slot 132 to limit the range of movement between the first member 20 and the second member 80. A similar arrangement (e.g., a detent and a correspondingly sized receiving cavity) may be and is in fact preferably used to center the second member 80 on the first member 20 for the initial installation. Notwithstanding the foregoing, preferably the clip assembly 10 does not limit the amount of relative movement between the first member 20 and the second member 80. In this case, it may be desirable to otherwise limit/restrict the movement of one or more of the panels (e.g., by pinning certain of the roofs' panels to the substructure).

Figure 6A:
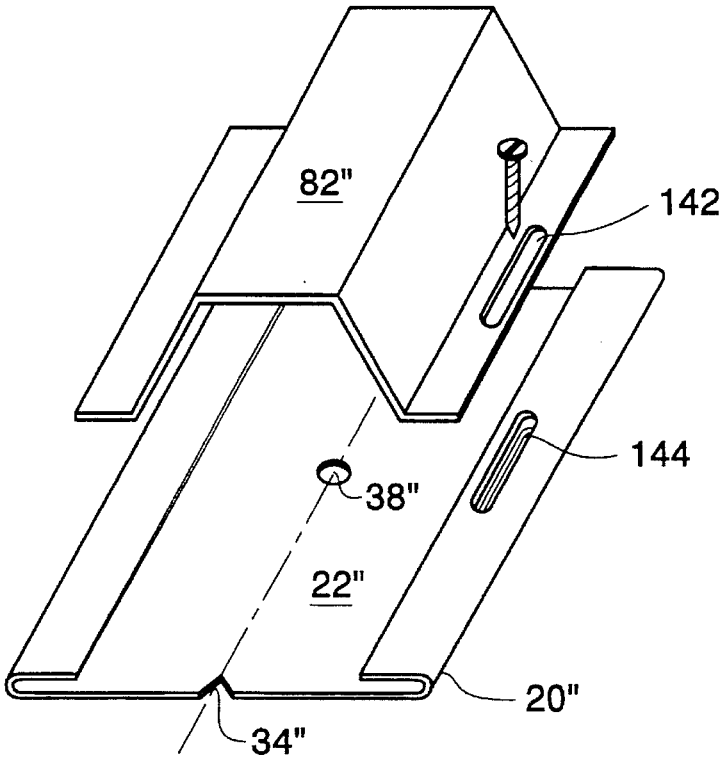
FIGS. 6A–B are perspectives of another clip assembly in accordance with the present invention.
Figure 6B:
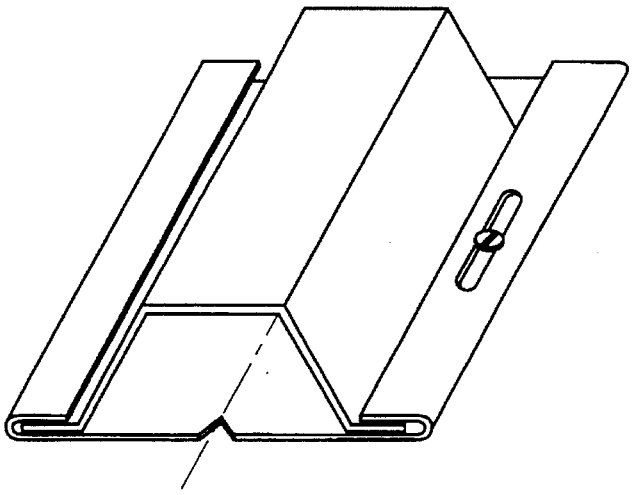
Figure 7A:
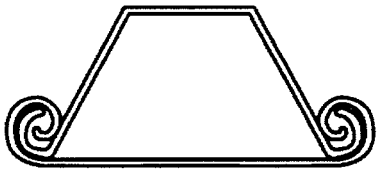
FIGS. 7A–D are end profiles of various other configurations of clip assemblies in accordance with the present invention.
Figure 7B:
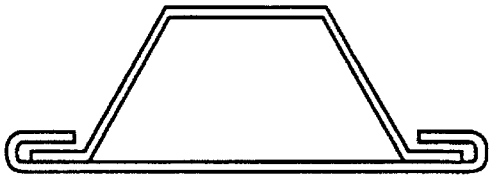
Figure 7C:
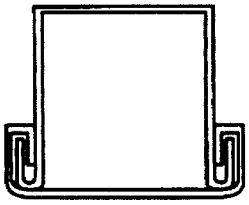
Figure 7D:
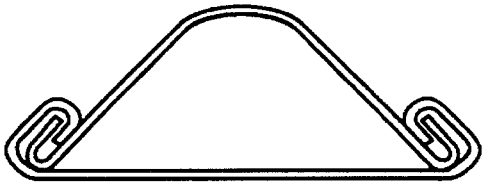

Another way for limiting the range of motion between the two members of the clip assembly of the present invention is illustrated in FIGS. 6A and 6B in the alternate configuration of the clip assembly 10" presented in FIG. 7B. The embodiment disclosed in FIG. 6A has a first slot 142 cut into first member 20 and a second slot 144, cut into the second member 80. As illustrated in FIG. 6B, a screw or other fastener may be driven through the slots after the clip assembly has been assembled to limit the relative longitudinal movement between the first member 20 and the second member 80.

Other configurations of clip assemblies in accordance with principles of the present invention are illustrated in FIGS. 7A–D. Generally, the upper part of the second member 80 may be configured to match the profile of the particular metal panel which is being installed. Moreover, it should be appreciated that the first member 80 may be similarly configured to match the profile of the underlying support structure.

The clip assemblies of the present invention may be installed in a variety of manners, including for instance using a substantially flat support structure 180 such as a plywood deck. FIG. 8A is a perspective view of a plurality of clip assemblies 10 in accordance with the present invention positioned on such a support structure 180. In one method of employing the clip assemblies 10 to secure a roof panel to an underlying support structure 180, the clip assemblies 10 are assembled at the construction site. In this method, the clip assemblies 10 are positioned by first snapping a chalk line 184 to define a longitudinal axis on the sub-roof and then using the notches 34, 36 on the base 22 to align the first member 20 with the longitudinal axis defined by the chalk line 184. The first member 20 is then secured to the sub-roof 180 by driving a screw or other fastener through the hole 38 in base 22 as previously discussed. The second member 80 is then slidably engaged with the first member 20 and may be centered thereon using the above-noted type of detent and receiving cavity assembly. This process is repeated until the appropriate number of clip assemblies 10 are positioned in substantial longitudinal alignment on the sub-roof 180, as illustrated in FIG. 8A. A ribbed roof panel 160 may then be positioned over the portion of sub-roof 180 and secured to the clip assemblies 10 using screws or other appropriate fasteners.

FIG. 8C is a cross-sectional view of a clip assembly of FIG. 8A, taken along line C—C, after a metal roof panel 160 has been secured to the clip assembly 10. As illustrated in FIG. 8C, a screw secures first member 20 to the plywood sub-roof 180. The roof panel 160 is secured to the platform 82 of the second member 80 using a self-tapping metal screw or other like fastener. Advantageously, the roof panel 160 is secured to the clip 10 along a peak 170 of the panel 160, which reduces the possibility of water leakage through the roof panel 160. The disclosed embodiment of clip 10 measures approximately 15/16 inch (e.g., 0.875") in height which provides a slight gap (e.g., approximately 0.125") between the trough 162 of a roof panel and the sub-roof 180. When the roof panel 160 is under load, such as by snow, ice, or other debris, the panel may bend such that the troughs 162 may come into contact with the sub-roof 180, thereby allowing the sub-roof 180 to directly support portions of the panel 160.

The clip assemblies of the present invention may also be installed using laterally extending installation strips. FIG. 9A is a perspective a plurality of clip assemblies 10 in accordance with the present invention positioned on a portion of a support structure 180 employing laterally disposed strips 182. As previously discussed, a chalk line 184 may be used to define a longitudinal axis on the support structure 180. Moreover, when purlins 182 are employed preferably one or more of the above-described downwardly projecting wedges 40, 42 are used to center the clip assembly 10 on the strip 182. Nonetheless, the first member 20 of each clip assembly 10 is secured to the strip 182 using a screw or other conventional fastener. The clip assembly 10 is then assembled and the roof panel 160 is secured thereon as discussed above.

Figure 8B:
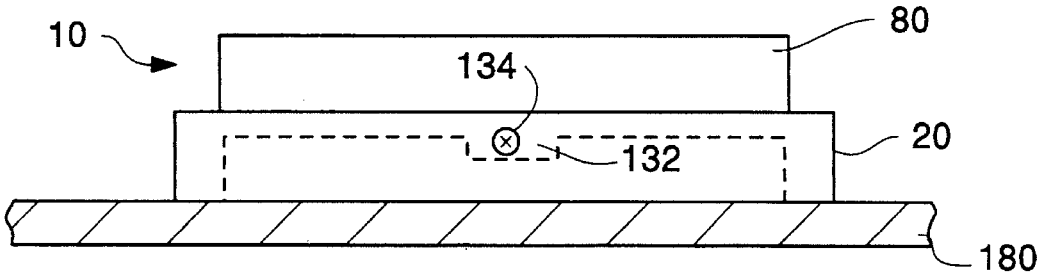
FIG. 8B is a side view of the clip assembly of FIG. 8A.

FIG. 9B is a side view of the clip assembly of FIG. 4 mounted on a strip 182. As illustrated in FIG. 8B, the first and second downwardly extending triangular wedges 40, 42 are disposed adjacent the first and second sides of the strip 182, respectively. The downwardly extending wedges 40, 42 facilitate centering the clip assembly 10 over the strip 182 and contribute to securing the clip assembly 10 on the strip 182. As illustrated in FIG. 9B, a gap exists between the bottom of the clip assembly 10 and the sub-roof 182. This configuration may be employed when it is desirable to have air space between the roof panel and the support structure either for ventilation of the sub-roof deck or such as when insulation may be required between the roof panel 160 and the support structure 180.

FIG. 9C is a cross-sectional view of a clip assembly 10 of FIG. 9A, taken along line 2—2, after a metal roof panel 160 has been secured to the clip assembly 10. As illustrated in FIG. 9C, a screw secures first member 20 to the strip 182. The roof panel 160 is secured to the platform 82 of the second member 80 using a self-tapping metal screw or other like fastener. As previously discussed, the roof panel 160 is secured to the clip 10 along a peak 170 of the panel, which reduces the possibility of water leakage through the roof panel. Further, there exists a slight gap (e.g., approximately 0.125") between the trough 162 of a roof panel 160 and the strip 182. Therefore, when the roof panel 160 is under load, the panel may bend such that the troughs 162 may come into contact with the strips 182, allowing the strips 182 to directly support portions of the panel 160.

Figure 10B:
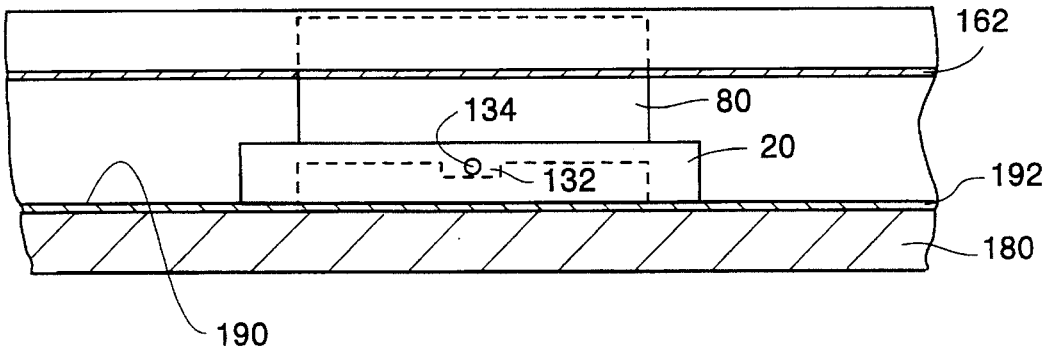
FIG. 10B is a side view of the clip assembly of FIG. 10A.

The clip assemblies of the present invention may also be used to install a metal roof over an existing metal roof. FIGS. 10A to 10C illustrate the use of a clip assembly in accordance with the present invention to mount a ribbed metal roofing panel 160 directly above an existing metal panel roof 190. This method may be desirable to save the time and expense of removing the existing metal roof 190 to expose the sub-roof 180. This method employs a clip assembly 10 of substantially the same configuration as the disclosed clip assembly but approximately twice the height. The first member 20 of each clip is mounted in a trough 192 of an existing roof using a screw or other fastener to secure the clip to the sub-roof 180 beneath the existing roof panel 190. A ribbed metal roof panel 160 is placed over the clips 10 as illustrated in FIG. 10C and secured to the clips 10 using screws or other like fasteners.

As illustrated in FIG. 10C, the upper metal roof panel 160 is secured to the platform 82 of the clip assembly 10 along the peak of the roof panel 170. Additionally, when the upper roof panel 160 is secured to the lower roof 190 as illustrated in FIG. 10C, portions of the trough 162 of the upper panel may be supported by portions of the peaks 200 of the lower panel 190 when the upper roof panel 160 is under load.

The foregoing description of the present invention has been presented for purposes of illustration and description. Furthermore, the description is not intended to limit the invention to the form disclosed herein. Consequently, variations and modifications commensurate with the above teachings, and skill and knowledge of the relevant art, are within the scope of the present invention. For instance, although not illustrated, the mounting clips of the present invention may also be used when installing a metal roof on an open substructure, such as a frame. The embodiments described hereinabove are further intended to explain best modes known of practicing the invention and to enable others skilled in the art to utilize the invention in such, or other embodiments and with various modifications required by the particular application(s) or use(s) of the present invention. It is intended that the appended claims be construed to include alternative embodiments to the extent permitted by the prior art.

What is claimed is:

1. A building assembly comprising:

an underlying building support structure;

a first building panel;

a first member comprising a base and first and second laterally displaced channel members, said first and second channel members each being interconnected with said base, said first member being attached to one of said first panel said and underlying support structure;

a second member comprising a platform and first and second laterally displaced leg members, said first and second leg members each being interconnected with and extending away from said platform, wherein a portion of said first and second leg members are slidably interconnected with said first and second channel members, respectively, said second member being attached to the other of said first panel and said underlying support structure; and means for allowing said first member to move relative to said second member in a direction which is generally parallel with said first and second channel members.

2. The building assembly of claim 1, wherein said first member is attached to said support structure, said assembly further comprising means for positioning said first member in a predetermined relationship relative to said support structure before attachment of said first member to said support structure.

3. The building assembly of claim 2, wherein said means for positioning comprises a notch on said base of said first member.

4. The building assembly of claim 2, wherein said base has first and second ends and a central longitudinal axis extending between said first and second ends, said first and second members being movable relative to each other in a direction coinciding with said axis, said means for positioning comprising first and second notches on said first and second ends, respectively, substantially along said axis.

5. The building assembly of claim 2, wherein said means for positioning comprising a projection extending from a lower surface of said base, said first and second channel members being on an upper surface of said base.

6. The building assembly of claim 2, wherein said means for positioning comprises first and second longitudinally displaced projections which extend from a lower surface of said base, said first and second channel members being on an upper surface of said base.

7. The building assembly of claim 1, further comprising means for securing said first member to said underlying support structure.

8. The building assembly of claim 7, wherein said means for securing comprises a hole in said base member, said hole being positioned substantially along a central, longitudinal axis of said clip assembly.

9. The building assembly of claim 1, wherein said base is disposed substantially entirely in a first plane and said first and second channel members extend upwardly away from said base end are disposed at an acute angle relative to said first plane.

10. The building assembly of claim 1, said first and second channel members each comprise a first portion interconnected with and extending upwardly away from said base, and a second portion interconnected with said first portion and extending downwardly toward said base to define a channel between said first and second portions.

11. The building assembly of claim 1, wherein said base includes first and second sides which are substantially parallel with a central, longitudinal axis of said clip assembly, said first and second channel members being positioned on said first and second sides, respectively, and along substantially the entire length of said first and second sides, respectively.

12. The building assembly of claim 1, wherein said platform is disposed substantially entirely in a first plane and said first and second leg members are each disposed at an obtuse angle relative to said first plane.

13. The building assembly of claim 1, wherein said platform is substantially arcuate.

14. The building assembly of claim 1, wherein said platform is substantially planar.

15. The building assembly of claim 1, said first and second leg members each comprise a first portion interconnected with and extending downwardly away from said platform toward said base and a second portion interconnected with said first portion and extending upwardly toward said platform to define a channel between said first and second portions.

16. The building assembly of claim 1, wherein portions of said first and second channel members are frictionally engaged with portions of said first and second leg members, respectively.

17. The building assembly of claim 1, wherein portions of said first and second leg members contact portions of said base.

18. The clip assembly of claim 1, further comprising means for providing a predetermined range of relative motion between said first and second members in said direction generally parallel with said first and second channel members.

19. The building assembly of claim 18, wherein said means for providing comprising a slot in one of said first channel member and said first leg member and a projection in the other of said first channel member and said first leg member.

20. The building assembly of claim 1, wherein said clip assembly has a central longitudinal axis, said first and second members being substantially symmetrically positioned above said central longitudinal axis, said first and second members being vertically displaced.

21. A clip assembly, comprising:

an underlying building support structure;

roofing panel a first member having a longitudinal axis, wherein said first member is secured to said underlying support structure;

a second member slidably engagable with said first member in a direction substantially parallel with said longitudinal axis, wherein a portion of said second member is displaced from said first member, is substantially symmetrically positioned about said longitudinal axis, and is secured to said roofing panel; and means for allowing said first member to move relative to said second member in a direction which is generally parallel with said longitudinal axis.

22. The building assembly of claim 21, further comprising means for positioning said first member in a predetermined relationship relative to said support structure before attachment of said first member to said support structure.

23. The building assembly of claim 22, wherein said means for positioning comprises a notch on said first member.

24. The building assembly of claim 22, wherein said first member comprises a base having first and second ends and a central longitudinal axis extending between said first and second ends, said first and second members being movable relative to each other in a direction coinciding with said axis, said means for positioning comprising first and second notches on said first and second ends, respectively, substantially along said axis.

25. The building assembly of claim 22, wherein said means for positioning comprising a projection extending from a lower surface of said first member.

26. The building assembly of claim 22, wherein said means for positioning comprises first and second longitudinally displaced projections which extend from a lower surface of said first member.

27. The building assembly of claim 21, further comprising means for securing said first member to said underlying support structure.

28. The building assembly of claim 27, wherein said means for securing comprises a hole in said first member, said hole being positioned substantially along a central, longitudinal axis of said clip assembly.

29. The building assembly of claim 21, wherein said first member comprises base and first and second laterally displaced channel members, and wherein said second member comprises a platform and first and second laterally displaced leg members, said first and second leg members being interconnected with and extending downwardly away from said platform, wherein a portion of said first and second leg members slidably interface with said first and second channel members, respectively.

30. The building assembly of claim 29, wherein said base of said first member is disposed substantially entirely in a first plane and said first and second channel members extend upwardly away from said base and are disposed at an acute angle relative to said first plane.

31. The building assembly of claim 29, said first and second channel members each comprise a first portion interconnected with and extending upwardly away from said base, and a second portion interconnected with said first portion and extending downwardly toward said base to define a channel between said first and second portions.

32. The building assembly of claim 29, wherein said base includes first and second sides which are substantially parallel with a central, longitudinal axis of said clip assembly, said first and second channel members being positioned on said first and second sides, respectively, and along substantially the entire length of said first and second sides, respectively.

33. The building assembly of claim 29, wherein said platform is disposed substantially entirely in a first plane and said first and second leg members are each disposed at an obtuse angle relative to said first plane.

34. The building assembly of claim 29, wherein said platform is substantially arcuate.

35. The building assembly of claim 29, wherein said platform is substantially planar.

36. The building assembly of claim 29, said first and second leg members each comprise a first portion interconnected with and extending downwardly away from said platform and a second portion interconnected with said first portion and extending upwardly toward said platform to define a channel between said first and second portions.

37. The building assembly of claim 29, wherein portions of said first and second channel members are frictionally engaged with portions of said first and second leg members, respectively.

38. The building assembly of claim 29, wherein portions of said first and second leg members contact portions of said base.

39. The clip assembly of claim 29, further comprising means for providing a predetermined range of relative motion between said first and second members in a direction generally parallel with said longitudinal axis, wherein said means for providing comprises a slot in one of said first channel member and said first leg member and a projection in the other of said first channel member and said first leg member.

40. The clip assembly of claim 21, further comprising means for providing a predetermined amount of relative movement between said first and second members in a direction which is generally parallel with said longitudinal axis.

41. The building assembly of claim 40, said means for providing comprising a first longitudinally disposed cutout along a portion of said second member and a first stop member on said first member and extending through said cutout, wherein said first stop member and said cutout cooperate to limit relative movement between said first and second members.

42. The building assembly of claim 1, wherein said first and second members are each metal.

43. The building assembly of claim 21, wherein said first and second members are each metal.

44. A clip assembly for securing portions of a first panel to an underlying support structure, said clip assembly comprising:

a first member comprising a base and first and second laterally displaced channel members, said first and second channel members each being interconnected with said base, said first member being attachable to said underlying support structure;

means for positioning said first member in a predetermined relationship relative to said support structure before attachment of said first member to said support structure, wherein said means for positioning comprising at least one projection extending from a lower surface of said base, said first and second channel members being on an upper surface of said base;

a second member comprising a platform and first and second laterally displaced leg members, said first and second leg members each being interconnected with and extending away from said platform, wherein a portion of said first and second leg members are slidably interconnected with said first and second channel members, respectively, said second member being attachable to said first panel; and means for allowing said first member to move relative to said second member in a direction which is generally parallel with said first and second channel members when said first and second support members are attached to the first panel and underlying support structure, respectively.

45. The clip assembly of claim 44, wherein said at least one projection comprises first and second longitudinally displaced projections which extend from a lower surface of said base.

* * * * *